US006944995B2

(12) United States Patent
Duffey et al.

(10) Patent No.: US 6,944,995 B2
(45) Date of Patent: Sep. 20, 2005

(54) PREFABRICATED FRAME FOR CEILING FAN AND FABRICATION METHOD THEREFOR

(76) Inventors: Timothy J. Duffey, 2741 S. Bronco St., Las Vegas, NV (US) 89146; Judith E. Duffey, 2741 S. Bronco St., Las Vegas, NV (US) 89146

( * ) Notice: Subject to any disclaimer, the term of this patent is extended or adjusted under 35 U.S.C. 154(b) by 162 days.

(21) Appl. No.: 10/402,894

(22) Filed: Mar. 31, 2003

(65) Prior Publication Data

US 2004/0191071 A1 Sep. 30, 2004

(51) Int. Cl.[7] ..... G09F 7/18

(52) U.S. Cl. ..... 52/173.1; 52/745.19; 52/200; 52/39

(58) Field of Search ..... 52/173.1, 656.1, 52/656.9, 200, 39, 745.19; 362/253, 147, 148

(56) References Cited

U.S. PATENT DOCUMENTS 3,546,842 A * 12/1970 Blum ..... 52/506.07
3,845,601 A * 11/1974 Kostecky ..... 52/290
3,940,900 A * 3/1976 Russo ..... 52/656.1
4,713,916 A * 12/1987 Brooks, Jr. ..... 52/39
4,781,008 A * 11/1988 Lyons, Jr. ..... 52/656.1
5,671,580 A * 9/1997 Chou ..... 52/656.4
6,173,935 B1 * 1/2001 Gretz ..... 248/343
6,272,811 B1 * 8/2001 Hagen ..... 52/786.13
6,389,770 B1 * 5/2002 Santavicca ..... 52/474
6,408,922 B2 * 6/2002 Desrochers ..... 160/24

* cited by examiner

*Primary Examiner*—Naoko Slack
*Assistant Examiner*—Basil Katcheves
(74) *Attorney, Agent, or Firm*—Harry M. Weiss; Weiss, Moy & Harris, P.C.

(57) ABSTRACT

Prefabricated frames and fabrication methods thereof are disclosed. The prefabricated frames comprise substantially L-shaped frame members. In addition, spreader members and space adaptors coupled to the substantially L-shaped frame members adapt the prefabricated frames to the size and shape of a ceiling opening. The prefabricated frames are attached within the ceiling opening. A receiver member with a configuration adaptable for various sized ceiling openings is attached within the ceiling opening and permits an interior dome to be coupled to the substantially L-shaped frame members. When the receiver member has a recess and through hole to permit installation of a ceiling fan within the prefabricated frames, the ceiling fan is attached to the receiver member.

16 Claims, 3 Drawing Sheets

PREFABRICATED FRAME FOR CEILING FAN AND FABRICATION METHOD THEREFOR

FIELD OF THE INVENTION

This invention relates generally to prefabricated frames and methods for the fabrication thereof and, more specifically, to prefabricated frames for ceiling fans and methods for fabrication thereof

BACKGROUND OF THE INVENTION

In the past, various types of lighting systems for use in a room were developed. For example, initially use was made of incandescent lighting systems to provide lighting within a room. Subsequently, fluorescent lighting systems were developed because of the greater amount of light and lower costs associated with the use of fluorescent lights versus incandescent lights.

Current grid work type fluorescent lighting is common in construction applications where it is desirable to hide fluorescent bulbs from observers. Fluorescent lighting provides greater lumens than common light bulbs based on the wattage used. Fluorescent bulbs installed in an opening between an actual ceiling and a grid work frame are hidden by diffuser panels placed on the grid work frame resulting in a softer and more pleasing lighting effect. An example of a ceiling with an opening between an actual and a grid work frame is a soffit in a kitchen.

Many grid work frame ceilings are low in height and often observers prefer a feeling of greater height. Grid work frames with lowered ceilings are usually flat and take no advantage of the depth between the actual ceiling and grid work frames to provide greater height.

Usually fluorescent lights are parallel banks of fluorescent bulbs adjacent to two opposing walls, and attached to the actual ceiling within the opening and above the grid work frame. The fluorescent lights are behind diffuser panels within the grid work frame. Such construction limits the amount of lighting that is available and does not take advantage of attaching banks of fluorescent bulbs to the actual ceiling and adjacent to all available sidewalls within the opening above the grid work frame.

In many cases, observers may install ceiling fans to provide air circulation. Installing a ceiling fan into a ceiling below the height of the ceiling is possible. However, this further limits the feeling of height to the observer and takes no advantage of the space between the grid work frame and the actual ceiling above the grid work frame.

Current grid work frames are integral structures, which are expensive and difficult to replace. Installation of grid work frames occurs on-site and requires professional installation.

For the foregoing reasons, there is a need to provide a kit, frame structure and method of fabrication for easy installation of a prefabricated frame to replace a current grid work frame where it is desirable to provide greater ceiling height and illumination from banks of fluorescent bulbs. This kit may also provide for installation of a ceiling fan within the prefabricated frame, so that the entire structure is a prefabricated frame for a ceiling fan.

SUMMARY OF THE INVENTION

Accordingly, it is an object of this invention to provide a prefabricated frame assembly and method of installation of the prefabricated frame assembly.

It is a further object of this invention to provide a prefabricated frame assembly that can be transported as a kit.

It is a still further object of this invention to provide a prefabricated frame assembly kit that can be custom modified to facilitate installation thereof for various sized openings.

It is another object of this invention to provide a prefabricated frame assembly and method of installation thereof for use with a ceiling fan to be located within the prefabricated frame kit assembly.

PREFERRED EMBODIMENTS OF THE INVENTION

In accordance with one embodiment of this invention, a prefabricated frame assembly comprises, in combination, a plurality of substantially L-shaped frame members and means for connecting together the plurality of substantially L-shaped frame members to form a frame. The prefabricated frame assembly is a ceiling frame assembly. The prefabricated frame assembly includes a ceiling fan coupled to the ceiling frame assembly. The plurality of substantially L-shaped frame members have configurations to adapt the prefabricated frame assembly to the size and shape of a ceiling opening. The ceiling frame assembly includes spreader members coupled to the substantially L-shaped frame members. The ceiling frame assembly also includes space adaptors coupled to the substantially L-shaped frame members. The ceiling frame assembly further includes an interior dome coupled to the substantially L-shaped frame members. The ceiling frame assembly still further includes a flat receiver member connected to the interior dome. The receiver member has a configuration adaptable for various sized ceiling openings. The receiver member also has a recess and a through hole to permit installation of the ceiling fan within the prefabricated frame assembly. The receiver member further includes the ceiling fan attached to the receiver member.

In accordance with a second embodiment of this invention, a method for fabricating a frame assembly comprises the steps of providing a plurality of substantially L-shaped frame members and connecting together the plurality of substantially L-shaped frame members to form a frame. The method further includes the step of attaching spreader members coupled to the substantially L-shaped frame members. The method further includes the step of attaching space adaptors coupled to the substantially L-shaped frame members. The method further includes the step of attaching the frame assembly within a ceiling opening. The method still further comprises the steps of attaching a receiver member to the ceiling opening within the frame assembly and a ceiling fan to the receiver member. The method still further comprises the step of forming an interior dome coupled to the plurality of substantially L-shaped frame members.

The foregoing and other objects, features, and advantages of the invention will be apparent from the following, more detailed description of the preferred embodiments of the invention, as illustrated in the accompanying drawings.

DESCRIPTION OF THE INVENTION

Figure 1:
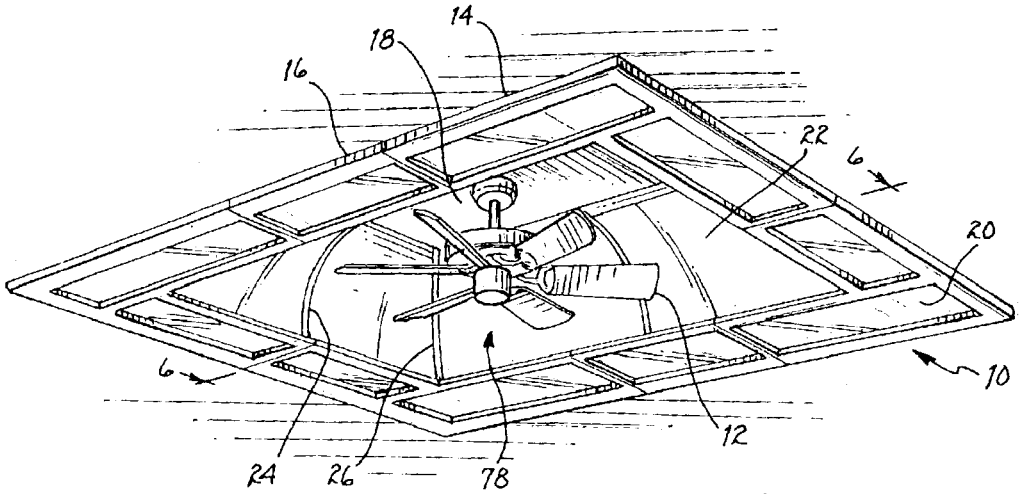
FIG. 1 is a bottom perspective view of a prefabricated frame assembly surrounding a ceiling fan recessed within frame members of the prefabricated frame assembly.

Referring to FIG. 1, a prefabricated frame assembly comprises a plurality of frame members 10 and a receiver member 18 surrounding a ceiling fan 12 mounted therein. A plurality of flat light diffuser panels 20 mounted within the frame members 10 provide for diffused lighting when illuminated by fluorescent lighting behind the flat light diffuser panels 20. According to FIG. 1 and FIG. 6, a multiplicity of curved light diffuser panels 22 held by tension between the frame members 10 and the receiver member 18 form a dome 78 in a ceiling opening 76 (see FIG. 6). In FIG. 1, a seam strip 24 connects each curved light diffuser panel 22 on the exterior surface of the dome 78, except at each ceiling corner of the dome 78 where a notched seam strip 26 connects the curved light diffuser panels 22 on the exterior surface of the dome 78.

Figure 2:
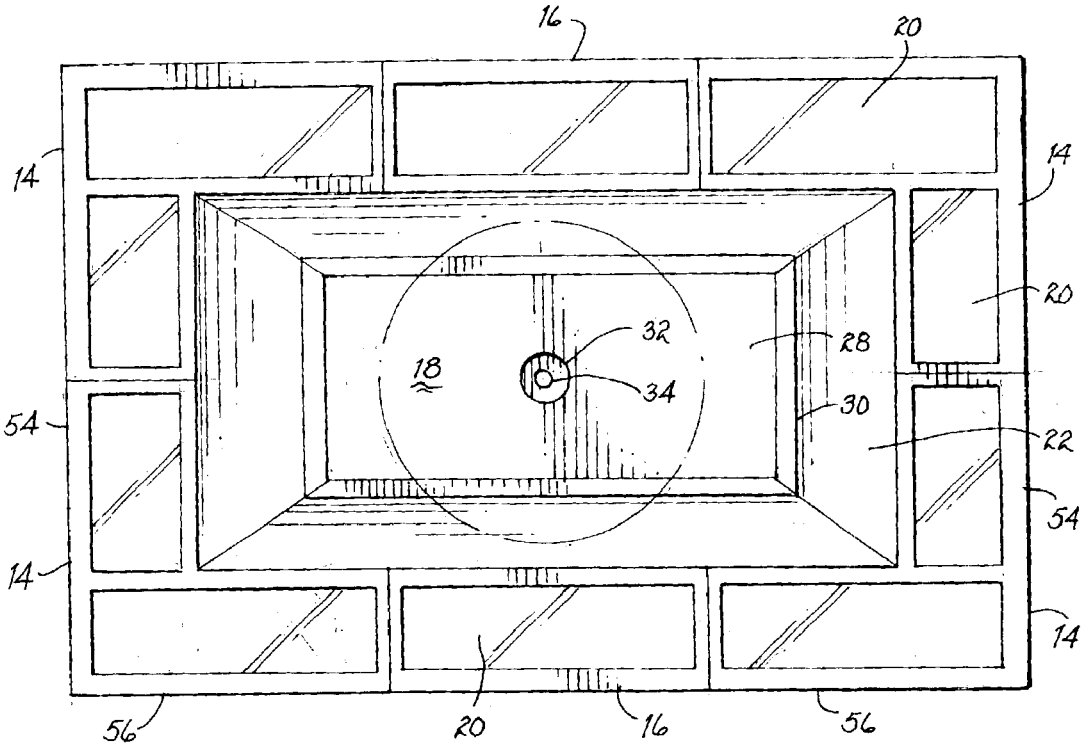
FIG. 2 is a bottom plan view of the prefabricated frame assembly of FIG. 1.

In FIG. 2 in this embodiment, the frame members 10 comprise four substantially L-shaped members 14, where each substantially L-shaped frame member has a first leg 54 and a second leg 56 and the angle between the first leg and the second leg is a right angle. Two spreader members 16 are aligned between two of the four substantially L-shaped frame members 14.

Substantially L-shaped members 14 means the angle between the first leg 54 of the L-shaped member 14 and the second leg 56 of the L-shaped member 14 is equal to a right angle or an obtuse angle, depending on the shape of the assembled frame members 10. For example, when assembled frame members 10 make a rectangle, the angle is a right angle. When assembled frame members 10 make an octagon, the angle is obtuse.

Figure 6:
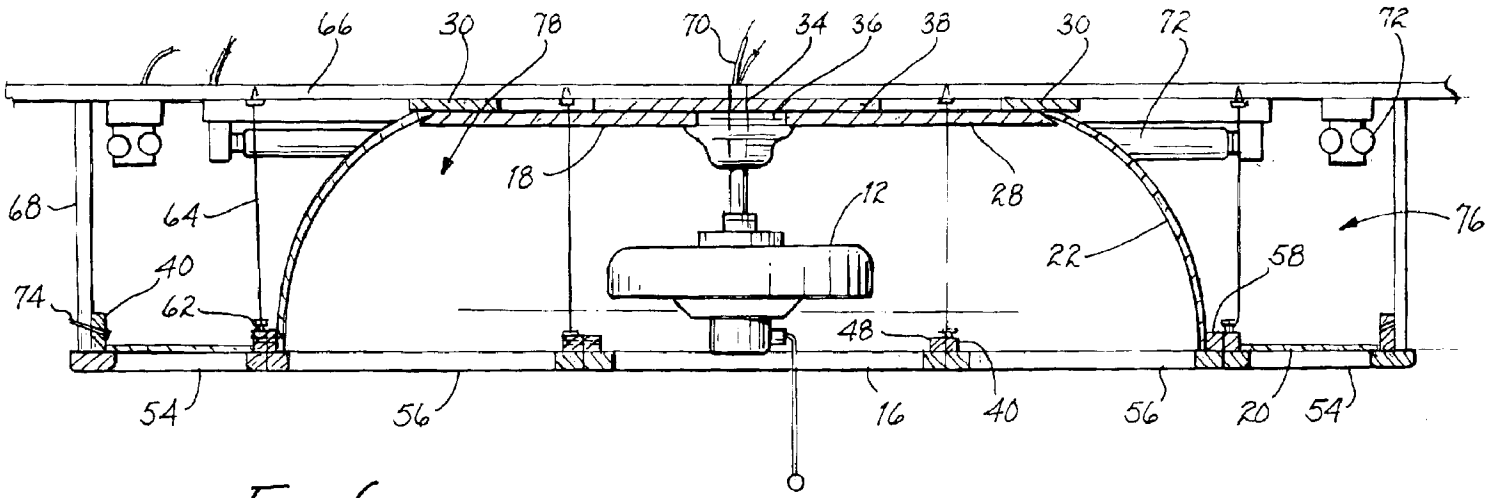
FIG. 6 is a cross section elevation view through 6—6 of the prefabricated frame assembly of FIG. 1.
Figure 8:
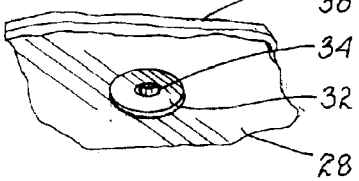
FIG. 8 is a bottom perspective view of a recess and a through hole for fan leads essentially centered within the recess of a receiver member of the prefabricated frame assembly of FIG. 1.

According to FIG. 2 and FIG. 6, curved light diffuser panels 22 extend from the assembled frame members 10 to an indentation formed between a receiver front panel 28, which has a chamfered edge and to a back frame 30 located on the back of the receiver member 18, which is flat. In this embodiment, the receiver front panel 28 has a recess 32 (see FIGS. 2 and 8) essentially centrally located in the receiver front panel 28 for receiving a fan front plate 36 (see FIG. 6). Within the recess 32 the receiver front panel 28 has a through hole 34 that is a conduit for fan leads 70 (see FIG. 6). The receiver front panel 28 provides a decorative ceiling within the dome 78.

Two common construction terms are used in this description, viz. a nailer and a waler. A nailer is a structural element attached to a member whose purpose is to provide a means for fastening the member to a surface. In construction, a common fastener is a nail (from which the term derives). A waler is another structural element whose purpose is to act as a strengthening and framing element attached to the surface of a member.

Figures 3, 4, 5:
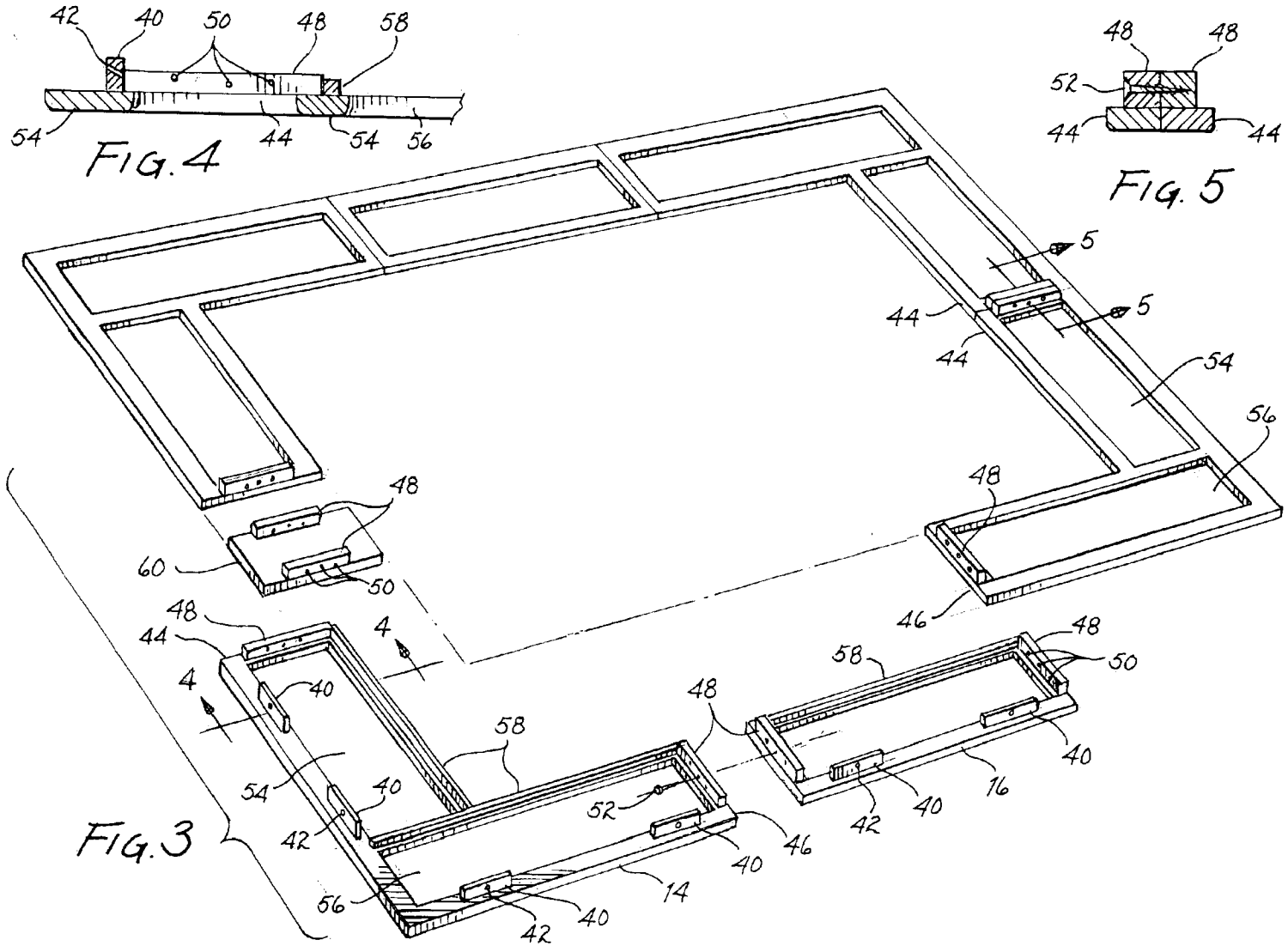
FIG. 3 is a top perspective view of the frame members of the prefabricated frame assembly of FIG. 1.
FIG. 4 is a cross section view through 4—4 of FIG. 3 of a nailer attached to the frame member on an enlarged scale.
FIG. 5 is a cross section view through 5—5 of FIG. 3 of in line fastener members attached to the frame members on an enlarged scale.

According to FIG. 3, each substantially L-shaped frame member 14 has an in line fastener 48 attached at a first end 44 of the substantially L-shaped frame member 14 and an in line fastener 48 attached at a second end 46 of the substantially L-shaped frame member 14. Each of the in line fasteners 48 have a multiplicity of predrilled in line holes 50 for receiving a multiplicity of in line screws 52 to couple frame members 10 to one another. The substantially L-shaped frame member 14 further has a waler 58 extending from the first end 44 of the substantially L-shaped frame member 14 affixed along the inner periphery of the first leg 54 of the substantially L-shaped frame member 14. A waler 58 extends from the second end 46 along the inner periphery of the second leg 56 of the substantially L-shaped frame member 14 and adjoins the waler 58 of the first leg 54. In addition, the substantially L-shaped frame member 14 further has a multiplicity of nailers 40 affixed near the inner edge of the outer periphery of the substantially L-shaped frame member 14, each nailer 40 having a predrilled inclined hole 42 for fastening to a sidewall 68 of the ceiling opening 76. The walers 58, nailers 40 and in line fasteners 48 of each substantially L-shaped frame member 14 are affixed to a surface on the same side of the substantially L-shaped frame member 14.

According to FIG. 3, each spreader member 16, is aligned and fastened between the second ends 46 of substantially L-shaped frame members 14. Each spreader member 16 has an in line fastener 48 attached at each end of the spreader member 16. The in line fasteners 48 attached to the spreader member 16 have predrilled in line holes 50, corresponding to the predrilled in line holes 50 of the in line fasteners 48 of the substantially L-shaped frame members 40, for receiving in line screws 52 to affix the second ends 46 of the substantially L-shaped frame members 14. The spreader has a waler 58 extending from the in line fasteners 48 at each end of the spreader member 16 and within the inner periphery of the spreader member 16. The spreader member 16 further has a multiplicity of nailers 40 affixed near the inner edge of the outer periphery of the spreader member 16, each nailer 40 having a predrilled inclined hole 42 for fastening to the sidewalls 68 of the ceiling opening 76. The nailers 40, waler 58, and in line fasteners 48 of each spreader member 16 are affixed to a surface on the same side of the spreader member 16. The walers 58 provide structural integrity for the frame members 10 and limit the movement of the flat light diffuser panels 20 and the curved light diffuser panels 22.

According to FIG. 3 a space adaptor 60 aligned and fastened between the first ends 44 of the substantially L-shaped frame member 14 allows for a better fit of the assembled frame members 10 within the ceiling opening 76, when this modification is necessary. The space adaptor 60 has an in line fastener 48 at each end of the space adaptor 60. The in line fasteners 48 of the space adaptor 60 have predrilled holes 50, corresponding to predrilled holes 50 of the in line fasteners 48 of the substantially L-shaped frame members 14, for receiving screws 52 to affix the first ends 44 of the substantially L-shaped frame members 14. The in line fasteners 48 of the space adaptor 60 are attached to a surface on the same side of the space adaptor 60.

Referring to FIG. 4, which is a cross section at 4—4 in FIG. 3, the nailer 40 having the predrilled inclined hole 42, is located near the edge of the outer periphery of the first leg 54 of the substantially L-shaped frame member 14. In addition, the in line fastener 48 having the predrilled holes 50 butts up against the waler 58, which is within the inner periphery of the first leg 54 of the substantially L-shaped frame member 14.

FIG. 5, which is a cross section at 5—5 in FIG. 3, shows further detail where the aligned in line fasteners 48 at the first ends 44 of the substantially L-shaped frame members 14 are fastened with the in line screw 52.

According to FIG. 6, which is a cross section at 6—6 of FIG. 1, the assembled frame members 10 are attached to the sidewalls 68 of the ceiling opening 76 with a plurality of nailer screws 74. The assembled frame members 10 suspended by wires 64, provide further structural stability. The wires 64 are attached to the ceiling 66 and hooks 62 on the assembled frame members 10. The curved light diffuser panels 22 are fixed in place by tension and extend from the waler 58 of the first leg 54 of the substantially L-shaped frame member 14 to the indentation between the receiver front panel 28 and the back frame 30. A multiplicity of fluorescent lighting fixtures 72 are fastened to the ceiling 66 above the flat light diffuser panels 20 that are within the frame members 10. According to this embodiment, the receiver member 18 comprises the receiver front panel 28 having the recess 32 and the through hole 34, the fan front plate 36, the back frame 30 and a fan back plate 38 having the through hole 34 for the fan leads 70. The fan back plate 38 is attached to the back of the receiver front panel 28 and strengthens the receiver member 18 when the fan 12 is attached to the face of the receiver member 18 (see FIGS. 6 and 8).

Figure 7:
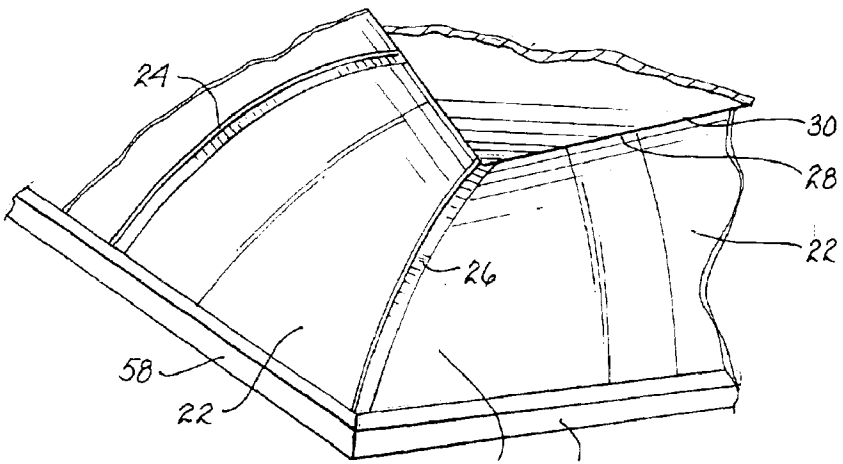
FIG. 7 is a perspective view of an inner corner of a dome of the prefabricated frame assembly shown in FIG. 1.
Figure 7A:
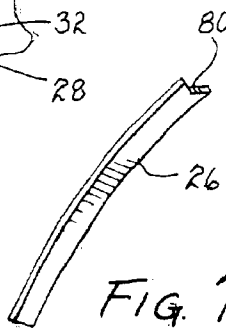
FIG. 7A is a perspective view of a notched seam strip at the corner of the dome shown in FIG. 7.

According to FIG. 7, the dome 78 has curved light diffuser panels 22 fixed in place by tension extending from walers 58 to the indentation between the receiver front panel 28 and the back frame 30. Seam strips 24 fixed in place by tension connect the curved light diffuser panels 22 on the exterior of the dome 78, and provide a finished appearance to the dome 78. The seam strips 24 fixed in place by tension, extend from the walers 58 to the indentation between the receiver front panel 28 and the back frame 30. Notched seam strips 26 on the exterior of the dome 78 connect the curved light diffuser panels 22, which meet at a ceiling corner. FIG. 7A is a detailed perspective view of the notched seam strip 26 with a notch 80 at one end. The notched seam strip 26 fixed in place by tension extends from the corner where walers 58 adjoin, with the notch 80 fitting into the indentation at the ceiling corner between the receiver front panel 28 and the back frame 30.

A description of the installation method for the prefabricated frame assembly follows. The frame members 10 are joined by aligning and fastening the substantially L-shaped frame members 14, spreader members 16, and when necessary, the space adaptors 60 using in line screws 52. The current fluorescent lighting fixtures 72 are relocated so they are fastened to the ceiling 66 above the measured position of the flat light diffuser panels 20 in the assembled frame members 10. The assembled frame members 10 are affixed to the sidewalls 68 of the ceiling opening 76 using nailer screws 74. In addition, the assembled frame members 10 are attached to the ceiling 66 by wires 64. The receiver member 18 (pre-customized to fit the ceiling opening 76) is attached to the ceiling 66 at ceiling joists, which provides strength of attachment for the receiver member 18 to the ceiling 66. The flat light diffuser panels 20 are placed within the frame members 10 extending from the ends of the frame members 14 and bounded between walers 58 and in line fasteners 48. The curved light diffuser panels 22 are placed between the walers 58 and the indentation between the receiver front panel 28 and back frame 30, except where the curved light diffuser panels 22 meet at the ceiling corners of the dome 78. In this embodiment, half the curved light diffuser panels 22 intended for the corners of the dome 78, are marked and cut to the curvature of the corners of the dome 78. These cut diffuser panels 22 mounted by tension between the walers 58 and the indentation between the receiver front panel 28 and back frame 30 meet the remaining half of uncut curved light diffuser panels 22 at each corner of the dome 78. Longer seam strips 24 are custom cut to provide seam strips 24 to fit between curved light diffuser panels 22 and notched seam strips 26 to fit at the corners of curved light diffuser panels 22, to complete the dome 78. In this embodiment, the fan 12 is attached to the face of the receiver member 18.

The frame members 10, pre-customized receiver member 18, space adaptors 60, lengthened seam strips 24, flat light diffuser panels 20 and diffuser panels to be used as curved light diffuser panels 22, in line screws 52 and nailer screws 74, together with installation instructions described above are a kit for making the prefabricated frame assembly. The installation instructions show stepwise methods, diagrams and photographic reproductions, and recommendations for installing the kit so that a non-professional may install the kit. Other construction components commonly used in construction finishing may also be included in the kit. The receiver member 18 having the recess 32 and the through hole 34 is optional depending on whether the ceiling fan 12 is to be installed The kit is easily shipped and parts are readily replaced. Frame members 10 are extendable at regular intervals allowing flexibility in the kit design. Additional fluorescent lighting fixtures 72 may be added when the old fluorescent lighting fixtures 72 are relocated.

In summary, the present invention is directed to a kit, frame structure and method of fabrication for easy installation of a prefabricated frame to replace a current grid work frame where it is desirable to provide greater ceiling height and illumination from banks of fluorescent bulbs, and allow installation of a ceiling fan within the frame structure if desired. The kit comprises frame members, which are fastened to provide a prefabricated frame that fits an opening within the current grid work frame structure, and replaces the grid work frame. The prefabricated frame is fastened to the sidewalls of the opening. Diffuser light panels are placed in the prefabricated frame and allow more fluorescent lighting to be added above each of the diffuser light panels. The kit has a receiver member included for attachment to the ceiling that receives curved light diffuser light panels held in place by tension from the prefabricated frame and gives the appearance of a dome. The receiver member may have a through hole for fan loads to allow installation of a ceiling fan. The receiver member also acts as the finished ceiling for the prefabricated frame structure. The kit has long seam strips that are cut to shape as notched seam strips for corner seams in the dome and seam strips at open edges where diffuser panels meet.

While the invention has been particularly shown and described with reference to preferred embodiments thereof, it will be understood by those skilled in the art that the foregoing and other changes in form and details may be made therein without departing from the spirit and scope of the invention, For example, the prefabricated frame kit can be altered in various ways within the basic concept of this invention. In particular, it is possible to assemble the prefabricated frame so that the frame's shape conforms to geometric openings such as octagons rather than Squares and rectangles. The materials of construction of the prefabricated frame can be altered. Examples of materials are common construction materials such as wood and its various products, medium density fiber, plastics and metals. In addition, other fastening methods may be used. Nut and bolt systems or snapping systems, which are commonly used for plastics, illustrate some alternative fastening methods. Seam strips are flexible materials. Diffuser panels made from flexible light diffusing materials having different grades, textures, colors and finishes. Various decorative designs can be used for the receiver member and the frame members.

What is claimed is:

1. A prefabricated frame assembly comprising, in combination:

a plurality of substantially L-shaped frame members, and means for connecting together said plurality of substantially L-shaped frame members to form a frame, said prefabricated frame assembly being a ceiling frame assembly;

said plurality of substantially L-shaped frame members having configurations to adapt the prefabricated frame assembly to the size and shape of a ceiling opening and including spreader members coupled to said substantially L-shaped frame members, each spreader member of said prefabricated frame assembly having an in line fastener attached at each end of each spreader member;

each of said plurality of substantially L-shaped frame members having an in line fastener attached at a first end of said substantially L-shaped frame member, and an in line fastener attached at a second end of said substantially L-shaped frame member, said in line fasteners fastening said substantially L-shaped frame members to one another;

said in line fasteners attached to each spreader member corresponding to said in line fasteners of said substantially L-shaped frame members to affix said second ends of said substantially L-shaped frame members;

a waler extending from said in line fasteners at each end of each spreader member and within an inner periphery of each spreader member; and a multiplicity of nailers affixed near an inner edge of an outer periphery of each spreader member, said nailers, said waler and said in line fasteners of each spreader member affixed to a surface on the same side of each spreader member.

2. The prefabricated frame assembly according to claim 1 including a ceiling fan coupled to said ceiling frame assembly.

3. The prefabricated frame assembly according to claim 1 including space adaptors coupled to said substantially L-shaped frame members.

4. The prefabricated frame assembly according to claim 3 wherein each space adaptor having an in line fastener at each end of each space adaptor; each of said plurality of substantially L-shaped frame members having an in line fastener attached at a first end of said substantially L-shaped frame member, and an in line fastener attached at a second end of the substantially L-shaped frame member, said in line fasteners fasten said substantially L-shaped frame members to one another; said in line fasteners of each space adaptor correspond to said in line fasteners of said substantially L-shaped frame members and join to said first ends of said substantially L-shaped frame members, said in line fasteners of each space adaptor attached to a surface on the same side of each space adaptor.

5. The prefabricated frame assembly according to claim 1 wherein an interior dome is coupled to said plurality of substantially L-shaped frame members.

6. The prefabricated frame assembly according to claim 5 wherein a flat receiver member is connected to said interior dome.

7. The prefabricated frame assembly according to claim 6 wherein said receiver member has a configuration adaptable for various sized ceiling openings.

8. The prefabricated frame assembly according to claim 6 wherein the receiver member has a recess and a through hole to permit installation of a ceiling fan within the prefabricated frame assembly.

9. The prefabricated frame assembly according to claim 6 further including a ceiling fan attached to said receiver member.

10. The prefabricated frame assembly according to claim 1 wherein each of said plurality of substantially L-shaped frame members having an in line fastener attached at a first end of said substantially L-shaped frame member, and an in line fastener attached at a second end of said substantially L-shaped frame member, said in line fasteners fasten said substantially L-shaped frame members to one another; a waler extending from said first end of said substantially L-shaped frame member affixed along an inner periphery of a first leg of said substantially L-shaped frame member and a waler extending from said second end of said L-shaped frame member along an inner periphery of a second leg of said substantially L-shaped frame member adjoining said waler of said first leg; a multiplicity of nailers affixed near an inner edge of an outer periphery of said substantially L-shaped frame member, said walers, nailers and in line fasteners of each substantially L-shaped frame member affixed to a surface on the same side of each substantially L-shaped frame member.

11. A method for fabricating a frame assembly comprising the steps of:

providing a plurality of substantially L-shaped frame members, each one of said plurality of L-shaped frame members having a first end and a second end, said first end of each one of said plurality of L-shaped frame members having a first in line fastener and said second end of each one of said plurality of L-shaped frame members having a second in line fastener, said in line fasteners adapted to fasten said substantially L-shaped frame members to one another;

providing spreader members having a pair of ends and an in line fastener at each one of said pair of ends of each of said spreader members, said in line fasteners of each one of said spreader members corresponding to said in line fasteners of said substantially L-shaped frame members to affix said second end of each one of said substantially L-shaped frame members;

providing a wafer extending from said in line fasteners at each end of each one of said spreader members and within an inner periphery of each one of said spreader members;

providing a multiplicity of nailers affixed near an inner edge of an outer periphery of each one of said spreader members, said nailers, said waler and said in line fasteners of each one of said spreader members affixed to a surface on the same side of each spreader member;

configuring said plurality of substantially L-shaped frame members and said spreader members to adapt said prefabricated frame assembly to the size and shape of a ceiling opening, said prefabricated frame assembly being a ceiling frame assembly; and connecting together at least said plurality of substantially L-shaped frame members to form a frame.

12. The method for fabricating a frame assembly according to claim 11 further including the steps of coupling said in line fasteners of each of said spreader members to said in line fasteners of said second end of each of said substantially L-shaped frame members; and coupling said in line fasteners of said first end of each of said substantially L-shaped frame members to one another.

13. The method for fabricating a frame assembly according to claim 12 including the step of forming an interior dome coupled to said plurality of substantially L-shaped frame members.

14. The method for fabricating a frame assembly according to claim 11 further including the steps of providing space adaptors; and coupling said space adaptors to at least one end of each of said substantially L-shaped frame members.

15. The method for fabricating a frame assembly according to claim 11 including the step of attaching said frame assembly within a ceiling opening.

16. The method for fabricating a frame assembly according to claim 15 comprising the step of attaching a receiver member to the ceiling opening within said frame assembly; and a ceiling fan to said receiver member.

* * * * *